United States Patent [19]

Puerner

[11] Patent Number: 4,832,625

[45] Date of Patent: May 23, 1989

[54] CONNECTOR KEYING SYSTEM

[75] Inventor: Dean A. Puerner, Maricopa, Ariz.

[73] Assignee: AMP Incorporated, Harrisburg, Pa.

[21] Appl. No.: 234,063

[22] Filed: Aug. 18, 1988

[51] Int. Cl.[4] ..... H01R 13/64

[52] U.S. Cl. ..... 439/681

[58] Field of Search ..... 439/596, 633, 677, 678, 439/680, 681, 686, 687

[56] References Cited

U.S. PATENT DOCUMENTS

| | | | |
|---|---|---|---|
| 3,441,661 | 4/1969 | Brummans | 174/138 F |
| 3,474,395 | 10/1969 | Ferdon et al. | 439/633 |
| 4,365,857 | 12/1982 | Watanabe et al. | 439/681 X |
| 4,376,565 | 3/1983 | Bird et al. | 439/681 |
| 4,580,868 | 4/1986 | Verstijnen | 439/680 |
| 4,666,325 | 5/1987 | Vantouroux | 439/680 X |
| 4,772,227 | 9/1988 | Pelzl et al. | 439/681 |
| 4,773,881 | 9/1988 | Adams, III | 439/681 |

*Primary Examiner*—Neil Abrams
*Assistant Examiner*—Stephen Zagrobelny
*Attorney, Agent, or Firm*—Anton P. Ness

[57] ABSTRACT

A plastic article is molded to have integral members deflectable and latchable within recesses as desired to program or encode the article. Plug and receptacle connector housings are molded with a plurality of deflectable members proximate their mating faces along housing side walls which become adjacent each other upon connector mating, the deflectable members associated in pairs. The deflectable members are joined to the respective housing side walls by integral hinges at rearward ends thereof and by frangible web portions proximate forward ends thereof. Recesses are formed in the housing side walls so that the deflectable members are deflectable thereinto if desired, enabling customizing of the connector housings to provide a system of keying particular plug housings with particular receptacle housings. In one embodiment the receptacle housing recesses are key-receiving grooves inwardly from the deflectable members thereof to receive thereinto corresponding undeflected deflectable members of the plug, and the forward ends of the deflectable members of the receptacle if deflected into the groove will block entry by an undeflected deflectable member of the plug and prevent mating. In another, the deflectable members of both the plug and receptacle housings are disposed to abut and prevent mating, if neither of each pair thereof is deflected out of the way prior to mating.

13 Claims, 5 Drawing Sheets

CONNECTOR KEYING SYSTEM

FIELD OF THE INVENTION

The present invention is directed to the field of electrical connectors and more particularly to the keying of matable connector housings.

BACKGROUND OF THE INVENTION

Various conventional keying arrangements utilize keying projections on one of a pair of matable connector housings which are received into corresponding keying grooves or channels of the other of the housings. Such keying arrangements permit mating of the appropriate corresponding connectors while preventing the mating of similar appearing connectors which are not intended to be mated. Certain prior art connectors include keying projections which are fabricated integrally with the housing at preselected locations, which necessitates manufacture of a plurality of housings different only in their particular keying projection arrangement. Other prior art connectors are first fabricated without keying projections, and separate key members are secured at desired locations in a further procedure.

It is desired to fabricate a plastic article which is programmable in a simple procedure without additional parts.

It is desired to fabricate a single design of connector housing including integral key projections wherein the housing is adapted to be particularly keyed after manufacture to achieve one of a plurality of keyed designs.

It is further desirable to fabricate both connector housings of a mating pair wherein each of the housings is adapted to be particularly keyed after manufacture to achieve one of a plurality of keyed designs, wherein the keyed designs of the two mating connectors are selected to permit mating to each other; and each of the two types of housings of the mating pair is of a single design for that type.

SUMMARY OF THE INVENTION

The present invention is a programmable plastic article comprising a member molded of plastic material including a relatively thin planar portion. A section initially protrudes from a surface of the thin planar portion and is integrally joined thereto by a hinge joint at a first end and also at least initially by frangible web sections at least proximate an opposed second end of the protruding section. A recess is molded into said thin planar portion adjacent and coinciding with the protruding section and having a periphery shaped and dimensioned to coincide approximately with the periphery of the protruding section, whereby the recess is adapted to receive the protruding section thereinto. The protruding section is adapted to be deflected into the recess if desired by breaking the frangible web sections at the second end and rotating the protruding section about the hinge joint at the first end and into the recess. An integral set of latching projections and latching recesses can be molded into or near the second end of the protruding section and adjacent recess walls to secure the protruding section in its deflected position. If desired however, the protruding section can be retained intact to remain in its protruding condition integral with the thin planar portion. The plastic article is programmable by either deflecting the protruding section into the recess or retaining it undeflected as desired, and a plurality of such protruding sections and corresponding recesses allows a plurality of combinations of selections for encoding purposes.

One particular useful embodiment of the present invention provides a dielectric first or plug connector housing molded of plastic material with keying projections molded integrally therewith at or near the forward end or mating face which can be deflected if desired into recesses of the housing body. A corresponding second or receptacle connector housing matable therewith molded of plastic material has corresponding key-receiving grooves extending rearwardly from the forward end or mating face of the connector, which can be blocked if desired by integral blocking members deflectable into the entrances to the grooves and securable in place. Each keying projection and each blocking member is joined to the respective connector housing body at an integral hinge at a first or rearward end, and is initially joined at a second or forward end to the respective housing body by frangible web portions.

Each keying projection and blocking member is molded in a first or undeflected position to permit if desired the breaking of the frangible web portions thus forming an actual free end, and the respective connector housing bodies permit the deflection of the free end a limited angular distance about the integral hinge to a second fixed position. The keying projections and blocking members and the respective housings include an integral latching system for securing the free ends to the housings in the deflected or second position. By so deflecting the free ends of selected ones of the keying projections and blocking members to respective second positions, the connector housings are customized to define first and second connector members particularly keyed to mate with each other.

It is an objective of the present invention to provide a plastic article easily programmable to encode it without using additional parts or special tooling.

It is a specific objective of the present invention to provide for particular keying of matable connector housings with means formed integral with the connector housings, eliminating additional parts.

It is a further objective to provide for particular keying of matable connectors through a simple process able to be performed remote from the site of housing fabrication, to customize connector housings otherwise of standard design and eliminating the necessity of an inventory of housings different only in their keying arrangement.

An embodiment of the present invention will now be described more particularly with reference to the accompanying drawings.

DETAILED DESCRIPTION OF THE PREFERRED EMBODIMENT

Figures 1, 2:
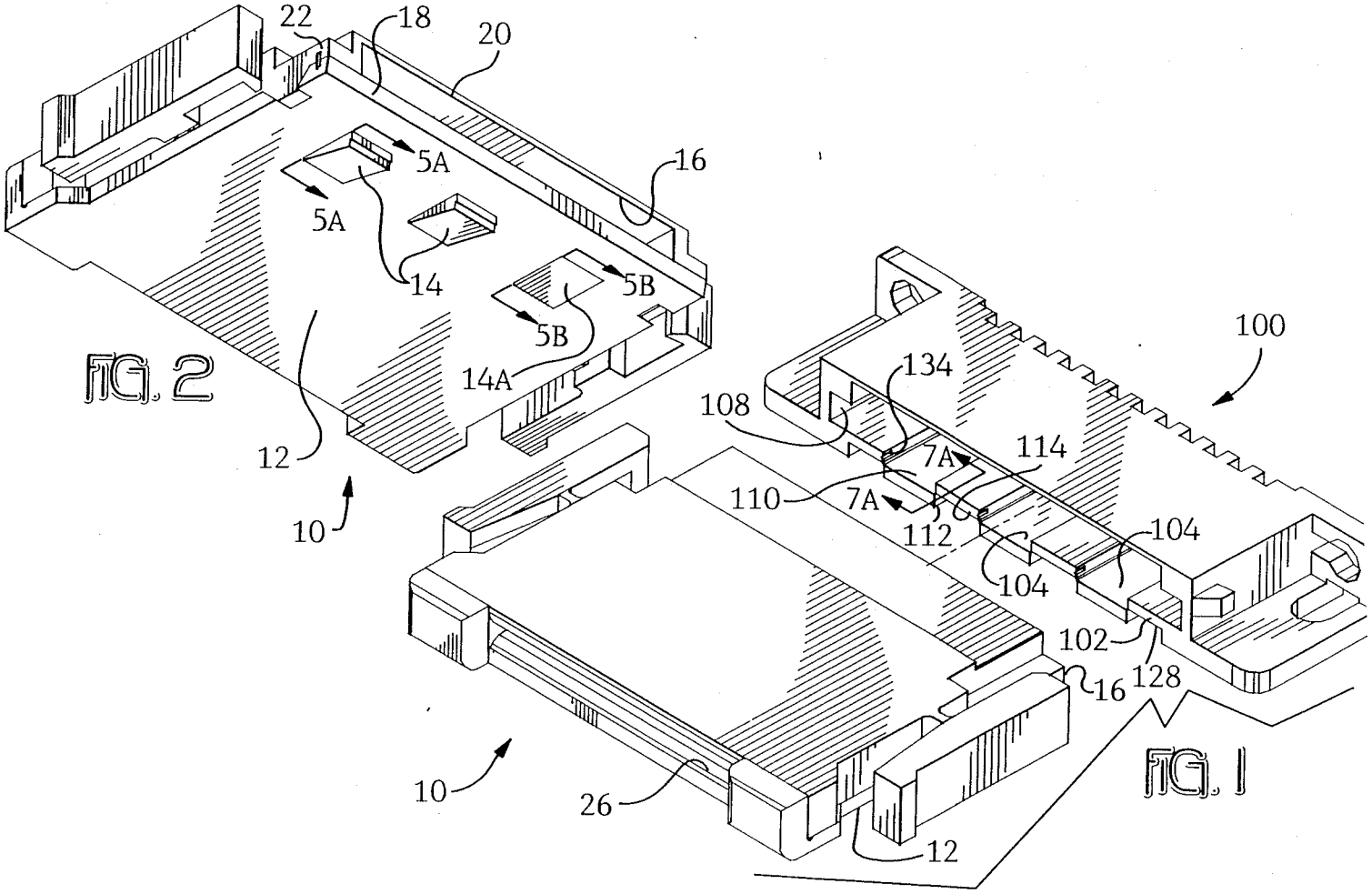
FIG. 1 is a perspective view of the plug and receptacle connectors having a keying system of the present invention.
FIG. 2 is a part perspective view of the bottom of the forward end of the plug connector having two keying projections undeflected and one deflected.

In FIG. 1 are illustrated plug connector housing 10 and receptacle connector housing 100 which are matable. Such housings can be used for electrically connecting a flat cable for conducting power, to a printed circuit panel for example. Plug housing 10 is securable to a relatively wide planar electrical terminal (not shown) terminated to the flat cable, such as the type disclosed in U.S. patent application Ser. No. 07/233,684 filed Aug. 18, 1988 and assigned to the assignee hereof. Receptacle housing 100 is shown as a header for being mounted to the surface of a printed circuit panel (not shown); the terminal to be contained in housing 100 could include a plurality of posts exiting the rearward housing face to be inserted into corresponding plated through-holesof the panel and soldered. Along mating face 102 of receptacle housing 100 are disposed a plurality of key-receiving grooves 104 along surface 106 which defines the lower surface of plug-receiving cavity 108. The shape of plug-receiving cavity and the forward end of the plug connector are shaped to permit mating only in one angular orientation and are thus polarized so that lower surface 12 of plug connector housing 10 is associated with inner surface 106 of receptacle connector housing 100 and will be disposed adjacent thereto upon mating.

Figure 3:
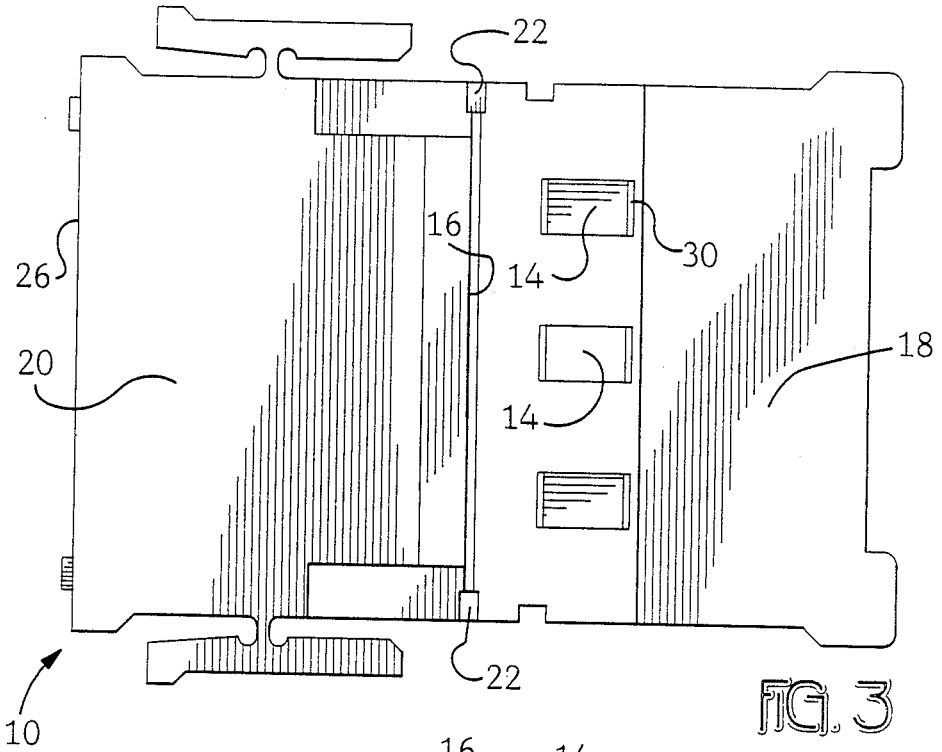
FIGS. 3 and 4 are bottom and elevation views of the plug connector as molded as an integral member with hingedly joined upper and lower housing sections.
Figure 4:
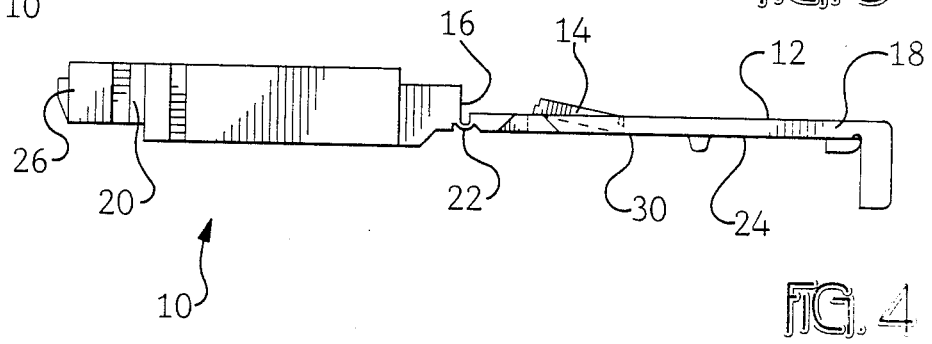

FIG. 2 illustrates the lower surface 12 of the forward end of plug housing 10, which contains a plurality of keying projections 14 extending outwardly from lower surface 12 proximate mating face 16, with keying projection 14A shown deflected. Keying projections 14 correspond in location with key-receiving grooves 104 of receptacle housing 100, and in this particular embodiment three associated pairs of keying projections and key-receiving grooves are shown although more may be utilized. Referring to FIGS. 3 and 4, plug housing 10 is molded for example of thermoplastic resin such as MAKRO Blend DP 41368 unfilled polycarbonate-polyethylene blend (product of Mobay Chemical Corporation, Pittsburgh, Pa.), or LEXAN 920 unfilled polycarbonate resin (product of General Electric Company, Pittsfield, Mass.). Plug housing 10 is molded as an integral member having a lower cover section 18 and an upper cover section 20 which are hingedly joined at hinges 22 at both ends of mating face 16. During assembly a terminal terminated to a flat power cable is placed along the inner surface 24 of lower cover section 18 so that the power cable extends rearwardly away from lower cover section 18 at cable exit 26. Then upper cover section 20 is rotated at hinges 22 to enclose the terminal between the upper and lower cover sections, and lower and upper cover sections 20,18 latch together along cable exit 26 to define the connector housing; contact sections of the terminal extend forwardly of mating face 16 to engage corresponding contact sections of the terminal within cavity 108 of the receptacle housing upon mating of the connectors.

Figure 5A:
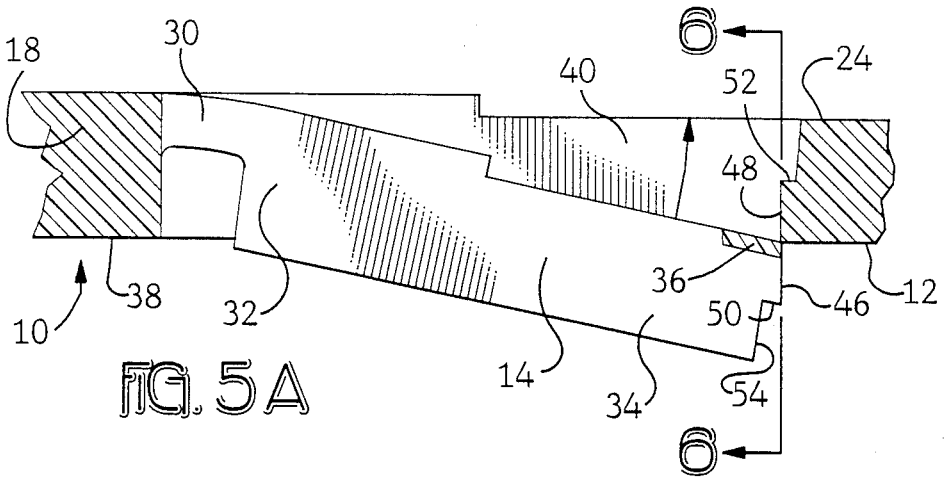
FIGS. 5A and 5B are enlarged longitudinal section views of a keying projection of the plug housing illustrating the deflection into a recess, taken along lines 5A—5A and 5B—5B respectively of FIG. 2.
Figure 5B:
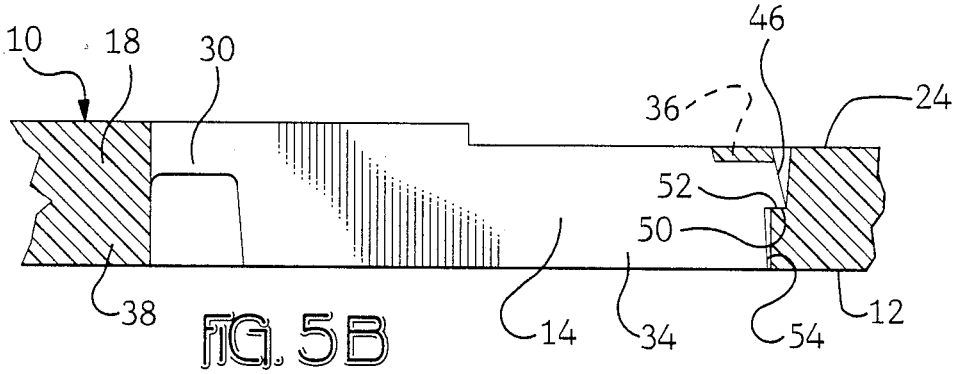
Figure 6:
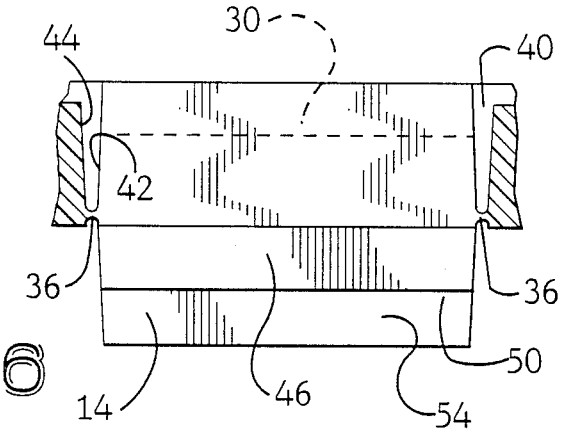
FIG. 6 is an enlarged cross-section view of an undeflected keying projection taken along line 6—6 of FIG. 5A.
Figure 7A:
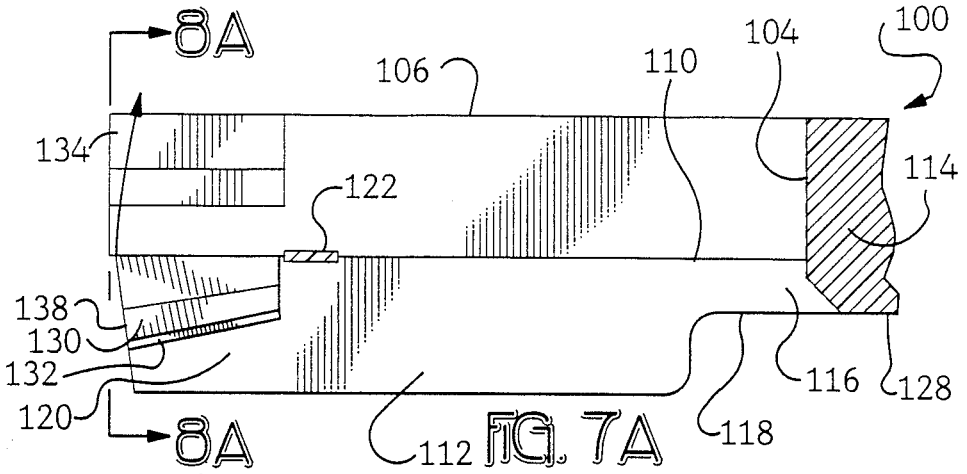
FIGS. 7A and 7B are enlarged longitudinal section views of a blocking member of the receptacle connector illustrating the deflection into a groove, with FIG. 7A taken along line 7A—7A of FIG. 1.
Figure 7B:
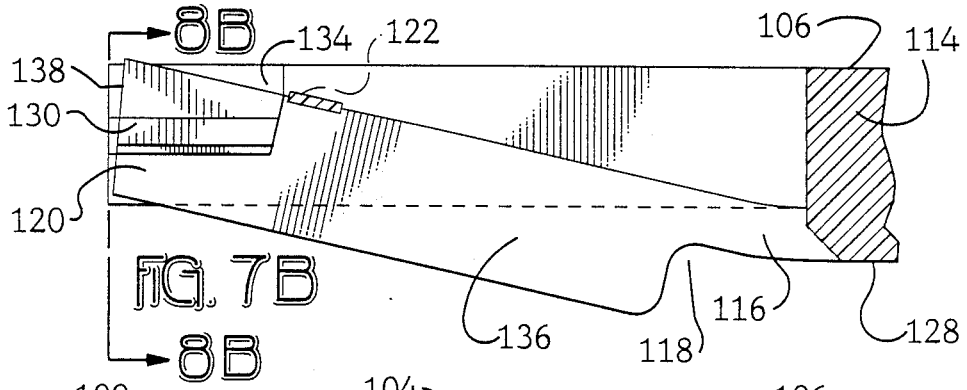
Figure 8A:
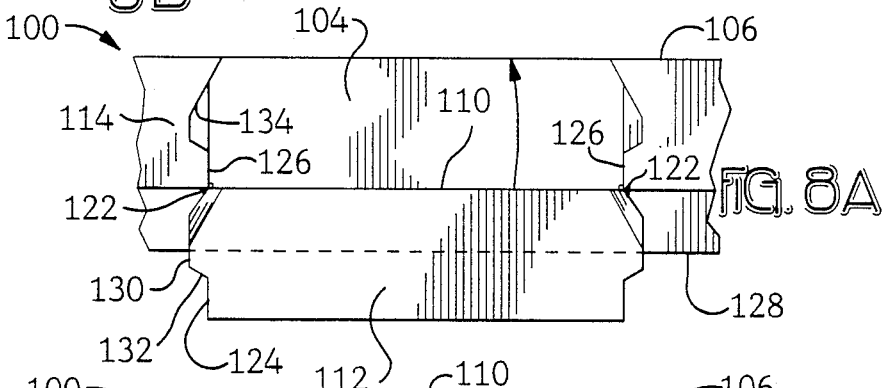
FIGS. 8A and 8B are enlarged views of the forward ends of blocking members in undeflected and deflected positions respectively, taken along lines 8A—8A and 8B—8B of FIGS. 7A and 7B respectively.
Figure 8B:
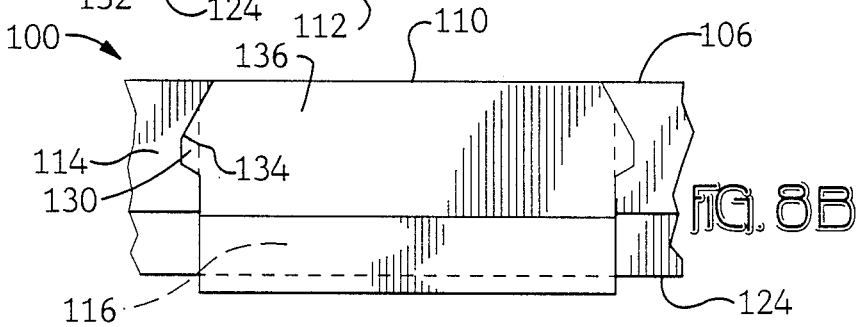

Referring to FIGS. 5A, 5B and 6, each keying projection 14 is joined to plug housing 10 at an integral hinge 30 at a first or rearward end 32, extends at an angle outwardly of for example 10° to 15° such as 12.2° and is initially joined at second or forward end 34 to plug housing 10 by frangible web portions 36. Integral hinge 30 comprises a thinner portion of material than the thickness of wall 38 of plug housing 10 to permit limited flexure, the plastic material being sufficiently resilient. Frangible web portions 36 are molded with sufficient thickness to remain intact during normal handling and mating and unmating, but may be broken if it is desired to deflect keying projection 14 into recess 40 formed adjacent thereto in housing wall 38; thus forward end 34 is a latent free end which becomes an actual free end upon breaking of web portions 36. Side portions 42 of keying projection 14 are spaced from recess side walls 44 to provide clearance for keying projection 14 to be rotated about integral hinge 30 completely into recess 40 during deflection.

Integral hinge 30 is located along inner surface 24 of wall 38, opposed from outer surface 12 from which keying projection initially protrudes when molded. The location of the hinge along inner surface 24 enables initially vertical forward edge 46 to progressively assume an angle during rotation and tend to jut further forwardly than the forward wall 48 of recess 40 thus generating an interference therewith. For a given thickness of material of wall 38, reducing the length of keying projection 14 enhances the interference fit by increasing the angular distance traveled by the line between the hinge and forward edge 46. If desired the hinge joint could be molded to protrude inwardly from inner surface 24 of wall 38, so that the center of rotation is offset inwardly from wall 38. An undercut in forward edge 46 defines an outwardly facing latching surface 50 which is cooperable with latching ledge 52 in recess forward wall 48 upon full deflection, and also defines a recessed forward edge portion 54.

During deflection keying projection 14 being comprised of resilient plastic material undergoes compression or slight elastic deformation due to the interference fit, aided probably by compression or slight elastic deformation of the integral hinge; when the forwardly protruding portion of forward edge 46 arrives at ledge 52 it will seat and relieve the compression and deformation. Recessed forward edge portion 54 preferably is molded to angle rearwardly about 12.2° (in the embodiment disclosed) so that upon rotation it becomes vertical and abuts against that portion of recess forward wall 48 below latching ledge 52, preventing overdeflection. Thus undercut 50 and ledge 52 comprise a latching system to retain deflected keying projection 14 in its second or fixed position within recess 40. By so deflecting the free ends of selected ones of keying projections 14 to respective second positions, plug housing 10 is customized to define a connector member particularly keyed to mate with a particular corresponding receptacle connector; undeflected ones of keying projections 14 provide the keying structure as their latent free ends 34 remain protruding out from lower surface 12.

Referring to FIGS. 7A, 7B, 8A and 8B, receptacle housing 100 may similarly be molded of thermoplastic material such as for example that used to mold plug housing 10. The bottom of each key-receiving groove 104 of receptacle housing 100 is defined by the inner surface 110 of a respective latent blocking member 112. Latent blocking members 112 are initially molded completely offset out of the plane of lower wall 114 defining surface 106 of terminal cavity 108, and outwardly from outer surface 128, as seen in FIG. 1. Similarly to keying projections 14 in FIGS. 2 to 6, each latent blocking member 112 is joined to receptacle housing 100 at an integral hinge 116 at a first or rearward end 118, and is initially joined at second or forward end 120 to receptacle housing 100 by frangible web portions 122. Integral hinge 116 comprises a portion of material thinner than the thickness of lower wall 114 of receptacle housing 100 to permit limited flexure, the plastic material being sufficiently resilient. Frangible web portions 122 are molded with sufficient thickness to remain intact under normal handling and mating and unmating of the housings, but may be broken if it is desired to deflect latent blocking member 112 into groove 104; thus forward end 120 is a latent free end which becomes an actual free end upon breaking of web portions 122. Side portions 124 of latent blocking member 112 are dimensioned to be spaced from groove side walls 126 to provide clearance for receiving forward end 120 of latent blocking member 112 to be rotated about integral hinge 116 and into groove 104 during deflection.

Integral hinge 116 is located along the outer surface 128 of lower wall 114 from which latent blocking member 112 initially protrudes when molded. The location of the hinge offset outwardly from the plane of lower wall 114 is necessary to form a key-receiving groove of appropriate depth. Proximate forward end 120 along side edges 124 are latching projections 130 defining downwardly facing stop shoulders 132 which are cooperable with latching recesses 134 in groove side walls 126 upon full deflection. As with keying projections 14, slight compression or deformation occurs during deflection, and latching projections then seat in latching recesses 134 and latch now-deflected blocking member 136 in place in a second or fixed position after it is rotated through an angular distance of for example between 10° and 15° such as 12.2°. The frangible web portions 122 along the side edges of the latent blocking member are axially displaced rearwardly from the latch projections 130 to facilitate molding.

Figure 9:
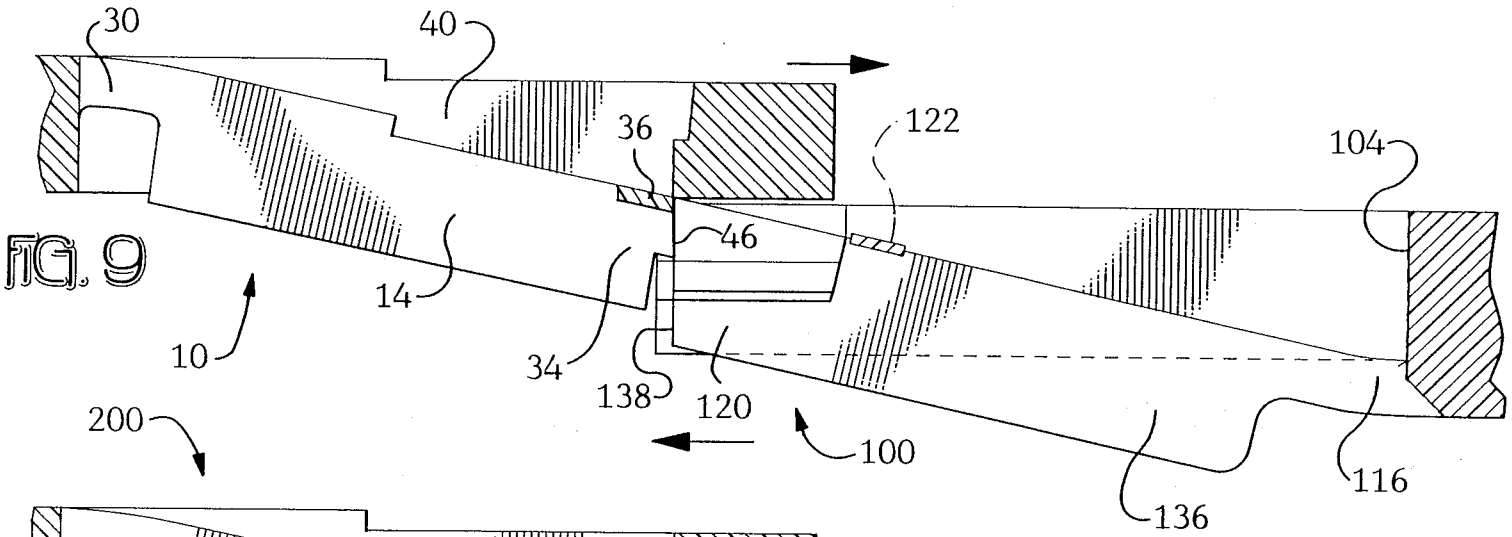
FIG. 9 is an enlarged longitudinal section view of the connectors of FIGS. 1 to 8B illustrating connector mating prevention by a deflected blocking member and an undeflected keying projection.

Deflected blocking members 136 provide the keying structure as their deflected free ends 120 block the entrances to key-receiving grooves 104. As seen in FIG. 9, blocking occurs when a deflected forward end 120 of a blocking member 136 abuts against a forward end 34 of an undeflected keying projection 14 of plug housing 10. The forward edge 138 of the latent blocking member free end 120 is tapered rearwardly and outwardly (such as at an angle of 12.2°) so that after deflection forward edge 138 presents a vertical surface to facilitate abutment without a tendency to act as a lead-in surface or as a bearing surface which would tend to pry the blocking member back out of the groove or to deflect an undeflected keying projection into its corresponding recess. By so deflecting the free ends of selected ones of latent blocking members 112 to respective second positions, receptacle housing 100 is customized to define a connector member particularly keyed to permit mating with an appropriately keyed plug connector.

Such an arrangement of correspondingly keyed plug and receptacle connectors would be especially useful in allowing easy customization of associated pairs of connectors among a group of otherwise identical and therefore otherwise matable pairs of connectors, to prevent mating of connectors not intended to be mated to each other where the connectors may be unmated and disconnected and remated and reconnected from time to time.

Figure 10:
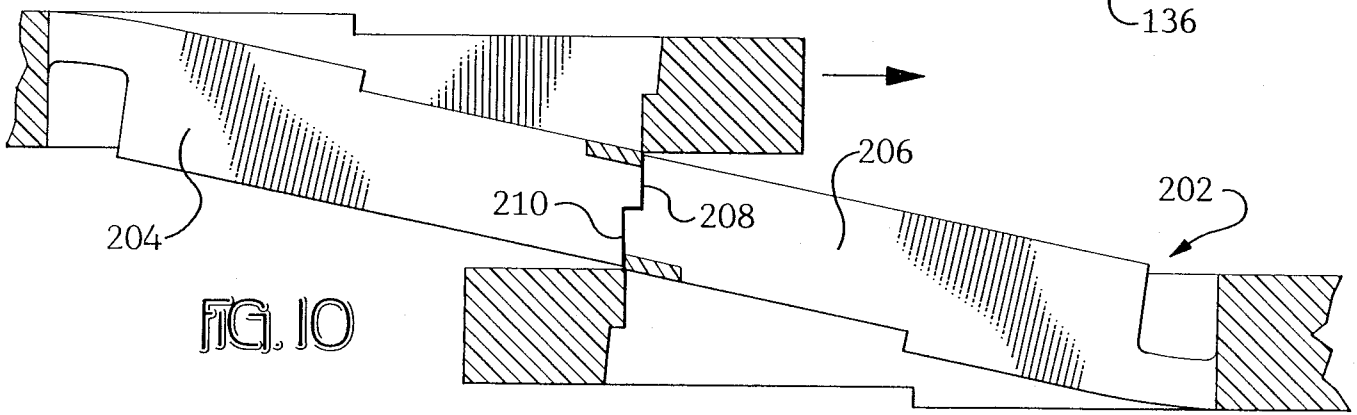
FIG. 10 illustrates keying of a second embodiment of the present invention.

In another embodiment a pair of matable connectors 200,202 could be keyed to each other where both connectors have keying projections 204,206 opposing each other in associated pairs with the keying projections of the plug connector housing 200 extending relatively outwardly and those of the receptacle connector housing 202 extending relatively inwardly. As shown in FIG. 10, if an associated pair of keying projections 204,206 were to remain undeflected their forward edges 208,210 would abut and prevent mating. Preferably all portions of forward edges 208,210 are vertical to avoid any tendency to deflect each other if moderately forced. Appropriate keying would occur if at least one keying projection of each pair were deflected into its recess. If all keying projections were deflected the deflected keying projections would of course pass by each other without abutment and mating would ensue.

It may be desirable to provide connectors with more than three keying arrangements, which would enable a correspondingly greater mismating prevention capability by providing a greater number of keying options. Keying projections could also be disposed on both major sides of the plug and receptacle instead of only one, again increasing keying options. In general molding of deflectable members integral with a plastic article may enable other types of encoding, such as by visible or tactile indicia. Other variations from the embodiments disclosed herein may occur to the skilled artisan which are within the spirit of the invention and the scope of the claims.

What is claimed is:

1. A keying system for matable plug and receptacle connector housings, comprising:

a plurality of first deflectable members molded integrally with a side wall of a plug connector housing proximate a mating face thereof and initially protruding outwardly from said side wall, said side wall having first recesses formed therein associated with and adjacent respective said first deflectable members, each said first recess dimensioned to permit receipt of a said first deflectable member thereinto upon deflection thereof, each said first deflectable member joined at a rearward end thereof by a hinge section to said side wall at a rearward end of a corresponding said first recess, each said first deflectable member joined proximate a forward end thereof by frangible web sections along side walls of said corresponding first recess, said forward end of each said first deflectable member including a substantially vertical forward edge portion, and each said first deflectable member and corresponding said first recess including integral means for securing therewithin said first deflectable member within said first recess upon deflection thereof; and a like plurality of second deflectable members molded integrally with a side wall of a receptacle connector housing proximate a mating face thereof and initially protruding in a selected direction from said side wall, said second deflectable members being located to correspond with said first deflectable members in associated pairs during connector mating, said side wall having second recesses formed therein associated with and adjacent respective said second deflectable members, each said second recess dimensioned to permit receipt of a said second deflectable member thereinto upon deflection thereof, each said second deflectable member joined at a rearward end thereof by a hinge section to said side wall at a rearward end of a corresponding said second recess, each said second deflectable member joined proximate a forward end thereof by frangible web section along side walls of said corresponding second recess, said forward end of each said second deflectable member including a substantially vertical forward edge portion, and each said second deflectable member and corresponding said second recess including integral means for securing therewithin said second deflectable member within said second recess upon deflection thereof, whereby at least a selected one of said first and said second deflectable members is deflectable from a first fixed position to a second fixed position to avoid abutment with an associated deflectable member and thereby key the plug and receptacle connectors housings to permit mating therebetween.

2. A keying system as set forth in claim 1 wherein said second deflectable members initially protrude outwardly from said side wall of said receptacle connector housing, said second recesses comprise key-receiving grooves extending rearwardly from said mating face of said receptacle connector housing and are adapted to receive thereinto corresponding ones of said first deflectable members during mating of said plug and receptacle connectors, said second deflectable members comprise bottoms of said key-receiving grooves, said integral means for securing a said second deflectable member within said groove comprise latching projections along side edges of said second deflectable member proximate said forward end thereof latchable within latching recesses along side walls of said groove, and deflection of a said second deflectable member into said groove blocks the entrance thereof, whereby mating of said plug and receptacle connector housings is prevented upon abutment of a forward edge of said second deflectable member with a said forward edge of an undeflected said first deflectable member associated with said second deflectable member.

3. A keying system as set forth in claim 2 wherein said frangible web portions initially joining said forward end of said second deflectable members to the associated said housing side wall are offset axially rearwardly from said latching projections and said latching recesses.

4. A keying system as set forth in claim 2 wherein said integral hinge of each said second deflectable member is offset outwardly from the associated said housing side wall thereby being disposed outside said groove associated with said second deflectable member.

5. A keying system as set forth in claim 4 wherein said forward edge of each said second deflectable member is initially tapered rearwardly and outwardly, whereby upon deflection of a said second deflectable member into a said groove by rotation about said integral hinge thereof said forward edge will be vertical facilitating stopping engagement with said forward edge of an undeflected said first deflectable member associated with said second deflectable member and preventing mating of said plug and receptacle connector housings.

6. A keying system as set forth in claim 1 wherein said plug connector housing includes structure proximate said mating face defining a forward wall of said first recesses, said integral means for securing a said first deflectable member within a corresponding said first recess comprises a stop shoulder defined along said forward edge of said first deflectable member latchably engageable with a cooperating latching ledge defined along said forward wall of said first recess upon deflection of said first deflectable member into said first recess.

7. A keying system as set forth in claim 6 wherein said integral hinge joining each said first deflectable member to said plug connector housing is disposed within said first recess proximate an inside surface of said housing side wall, and said forward edge includes an initially vertical portion extending outwardly from said forward wall of said recess, whereby upon deflection of a said first deflectable member into a said first recess by rotation about said integral hinge thereof said forward edge will tend to protrude forwardly of said forward recess wall and generate an interference fit therewith during deflection and facilitating latching after full deflection.

8. A keying system as set forth in claim 6 wherein said second deflectable members initially protrude inwardly from said side wall of said receptacle connector housing and are adapted to be deflected outwardly into corresponding said second recesses, said second deflectable members are shaped similarly to said first deflectable members and said second recesses are shaped similarly to said first recesses, and forward edges of said second deflectable members abut with said forward edges of associated said first deflectable members when said first and second deflectable members remain undeflected, whereby deflection of either one of said first and second deflectable members of each said associated pair thereof into a said first and second recess corresponding thereto permits mating of said plug and receptacle connector housings.

9. A programmable plastic article comprising a member molded of plastic material including a relatively thin planar portion, a section initially protruding from a surface of said thin planar portion and integrally joined thereto by a hinge joint at a first end and at least initially by frangible web sections at least proximate an opposed second end, and a recess in said thin planar portion having a periphery shaped and dimensioned to coincide approximately with the periphery of said protruding section, wereby the recess is adapted to receive the protruding section thereinto, and the protruding section is adapted to be deflected into the recess if desired by breaking the frangible web sections at the second end and rotating the protruding section about the hinge joint at the first end and into the recess, the protruding section remaining protruding and integral with the thin planar portion if retained undeflected, and whereby the article is programmable.

10. A programmable plastic article as set forth in claim 9 wherein said member includes integral means for securing said protruding section within said recess upon deflection thereinto.

11. A programmable plastic article as set forth in claim 10 wherein said member includes structure proximate an edge along said protruding section second end defining a forward wall of said recess, said integral means for securing said protruding section within said recess comprises a stop shoulder defined along said forward edge of said protruding section latchably engageable with a cooperating latching ledge defined along said forward wall of said recess upon deflection of said protruding section into said recess.

12. A programmable plastic article as set forth in claim 11 wherein said hinge joint is disposed within said recess proximate an inside surface of said thin planar portion, and said protruding section forward edge includes an initially vertical portion extending outwardly from said forward wall of said recess, whereby upon deflection of a said protruding section into said recess by rotation about said hinge joint thereof said protruding section forward edge will tend to protrude forwardly of said forward recess wall and generate an interference fit therewith during deflection and facilitating latching after full deflection.

13. A programmable plastic article as set forth in claim 10 wherein said second end of said protruding section is disposed along an edge of said thin planar portion, and said integral means for securing said protruding section within said recess comprise latching projections along side edges of said protruding section proximate said second end thereof latchable within latching recesses along side walls of said recess upon deflection of said protruding section thereinto in interference fit therewith.

* * * * *